US005466045A

United States Patent [19]

Akima

[11] Patent Number: 5,466,045

[45] Date of Patent: Nov. 14, 1995

[54] LUMBAR SUPPORT DEVICE

[75] Inventor: Hiroaki Akima, Akishima, Japan

[73] Assignee: Tachi-S Co., Ltd., Tokyo, Japan

[21] Appl. No.: 318,293

[22] Filed: Oct. 5, 1994

[51] Int. Cl.[6] ..... A47C 3/00

[52] U.S. Cl. ..... 297/284.8; 297/284.4

[58] Field of Search ..... 297/284.4, 284.8

[56] References Cited

U.S. PATENT DOCUMENTS

| | | | |
|---|---|---|---|
| 4,576,410 | 3/1986 | Hattori | 297/284.4 |
| 4,714,291 | 12/1987 | Hattori et al. . | |
| 5,011,223 | 4/1991 | Kato . | |
| 5,078,449 | 1/1992 | Suzuki | 297/284.4 |
| 5,215,350 | 3/1993 | Kato . | |
| 5,314,236 | 5/1994 | Suzuki et al. | 297/284.8 |

FOREIGN PATENT DOCUMENTS 3120848 11/1991 Japan .

*Primary Examiner*—Laurie K. Cranmer
*Attorney, Agent, or Firm*—Browdy and Neimark

[57] ABSTRACT

A lumbar support device for seat which is of such a structure wherein a lumbar plate is supported on the free end portion of an arm, and wherein the arm is operatively connected, at its base end portion, with a threaded drive mechanism via a guide element, while the intermediate portion of the arm is in a slidable contact with a fulcrum or support rod. The guide element comprises a generally arcuate guide hole formed in conformity with a locus along which the base end portion of the arm has to be displaced in order for the free end portion thereof to be moved on a straight line. Such slidable contact between the arm's intermediate portion and support rod, and provision of generally arcuate guide hole, materializes a linear movement of the lumbar plate on the same straight line in the fore-and-aft direction of the seat. Thus, the lumbar plate is prevented against dislocation in the width-wise direction of the seat, offering a stable support touch to the lumbar part of an occupant on the seat.

12 Claims, 3 Drawing Sheets

LUMBAR SUPPORT DEVICE

BACKGROUND OF INVENTION

1. Field of Invention

The present invention relates to a lumbar support device for use in an automotive seat.

2. Description of Prior Art

There has been known such a typical rotary type of lumbar support device as disclosed from the Japanese U.M. Laid-Open Pub. No. 3-120848 in the field of vehicle or automotive seats. FIG. 1 shows this sort of lumbar support device, which includes basic major elements: a motor (26'), a threaded rotary adjustment mechanism (16', 18'), an arm (14') and a lumbar plate (12'). The motor (26') is provided with a reduction gear (26'*a*) from which a threaded spindle (16') projects to engage a nut member (18') threadedly, constituting that threaded rotatry adjustment mechanism. The arm (14') is fixed at one base end portion thereof to the nut member (18') and has an outwardly extension (14*b*') formed therefrom. The outwardly extension (14*b*') is rotatably supported in a bracket (20') fixed on the motor (26'), forming a center of rotation of the arm (14'). Another free end portion (14'*a*) of the arm (14') is connected to the central part of the lumbar plate (12') in a rotatable manner. Thus, operation of the motor (26') causes vertical motion of the nut member (18') along the threaded spindle (16') to rotate the lumbar plate (12') relative to the arm end extension (14'*b*). Since the lumbar support device is provided within a seat back of automotive seat at a point corresponding to the lumbar part of an occupant on the seat, the lumbar plate (2) is rotatively displaced in the direction forwardly and backwardly of the seat back.

However, in this conventional lumbar plate device, the free end (14'*a*) of the arm (14') is simply rotated relative to the center (14'*b*) of rotation, and thus displaced on an arcuate path. As indicated by the arcuate arrow in FIG. 1, such mere circular rotation of the arm (14') or its free end (14'*a*) in the direction from the horizontal position (①) to an upward position (②) or vice versa results in the lumbar plate (12) being displaced laterally by an amount of "D". This has been found defective in varying the lumbar support point in the width-wise direction of seat back and making an occupant on the seat uneasy and unpleasant at his or her lumbar part, which deteriorates the fatigue alleviation effects of the lumbar plate (12').

SUMMARY OF THE INVENTION

In view of the above-stated shortcomings, it is a primary purpose of the present invention to provide an improved lumbar support device for a seat, which is simple in structure and prevents dislocation of a lumbar plate in the width-wise direction of the seat during operation.

In order to achieve such purpose, a lumbar support device in accordance with the present invention, basically comprises:

- a lumbar plate to support a lumbar part of an occupant sitting on the seat;
- an arm means having a free end portion on which the lumbar plate is supported, an intermediate portion and a base end portion;
- a bracket means;
- a fulcrum means which is so disposed at the bracket means as to receive the intermediate portion of the arm means in such a way that the arm means intermediate portion is in a slidable contact with the fulcrum means;
- a threaded drive mechanism provided in the bracket means, the threaded drive mechanism being operatively connected with the base end portion of the arm, whereby the arm base end portion is caused to move in a direction forwardly and backwardly of the seat; and
- a guide means workable in conjunction with the threaded drive mechanism to guide the arm base end portion along a predetermined locus, whereby the free end portion of the arm is displaced on a straight line in the direction outwardly and backwardly of the seat.

Accordingly operation of the threaded drive mechanism causes displacement of the lumbar plate on the straight line in a direction towards and away from the lumbar part of the occupant on the seat, thereby preventing a cricular rotation of the lumbar plate which causes the foregoing width-wise dislocation of the same.

Preferably, the fulcrum means may comprises a support rod fixed in said bracket means.

Preferably, the threaded drive mechanism comprises a lead screw spindle and a nut block member, both of which are threadedly engaged with each other, wherein the lead screw spindle is operable by an external drive means, while the nut block member is connected with the base end portion of the arm via the guide means.

In one aspect of the invention, thed guide means comprises a generally arcuate guide hole which is formed in conformity with the foregoing predetermined locus in order for the free end portion of said arm to be displaced on the straight line the direction forwardly and backwardly of the seat.

Further, a stopper means may be so operatively provided in said threaded drive mechanism as to permit for adjustably limiting a range within which the arm base end portion is moved in the direction forwardly and backwardly of the seat.

In a more preferred aspect of the invention, the generally arcuate guide hole may be formed in the bracket means in conformity with the above-mentioned predetermined locus, and additionally, an elongated guide hole may be formed in the nut block member of the threaded drive mechanism, such that the base end portion of the arm is slidably inserted through those generally arcuate and elongated guide holes. In operation, the nut block member is moved along the lead screw spindle, thus guiding the arm base end portion along the foregoing predetermined locus via such two guide holes so as to cause displacement of the arm free end portion on a straight line in the fore-and-aft direction of seat. Thus, the lumbar plate is insured to move on a straight line in a direction towards and away from the occupant's lumbar part.

DETAILED DESCRIPTION OF PREFERRED EMBODIMENT OF THE INVENTION

Figure 1:
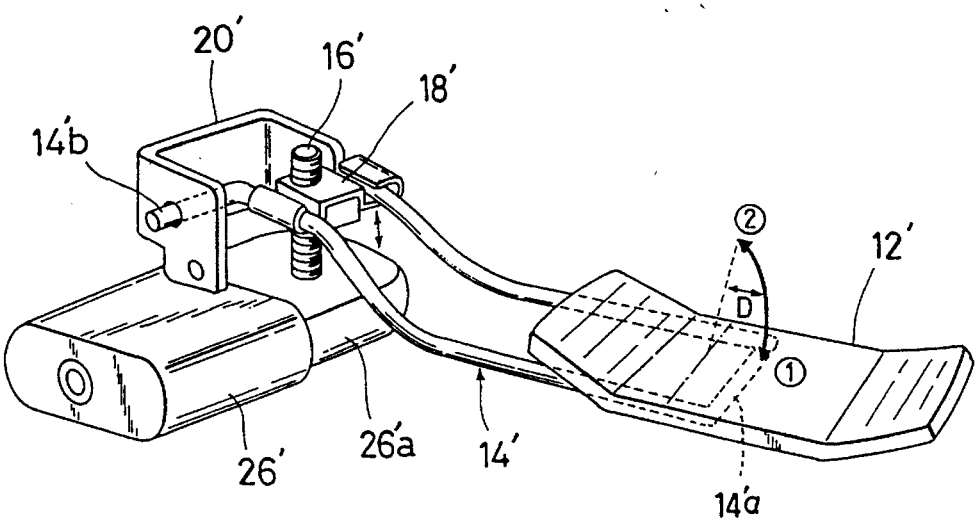
FIG. 1 PRIOR ART
FIG. 1 is a perspective view of a conventional lumbar support device.
Figure 3:
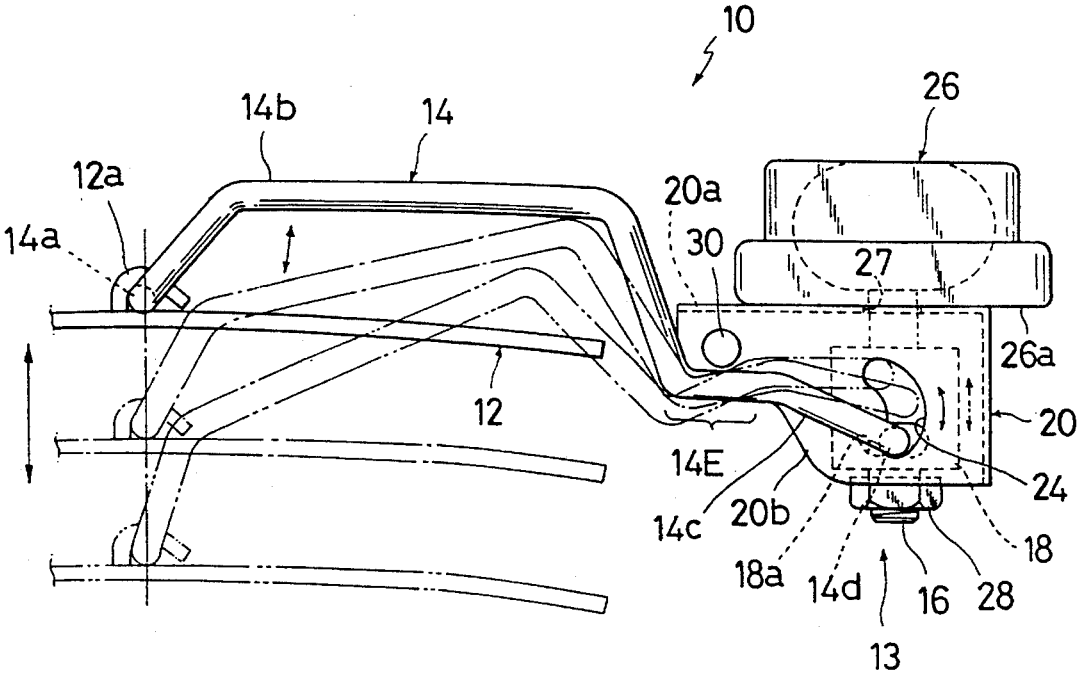
FIG. 3 a diagram as viewed from the above, showing the actions of the lumbar support device in FIG. 2.
Figure 2:
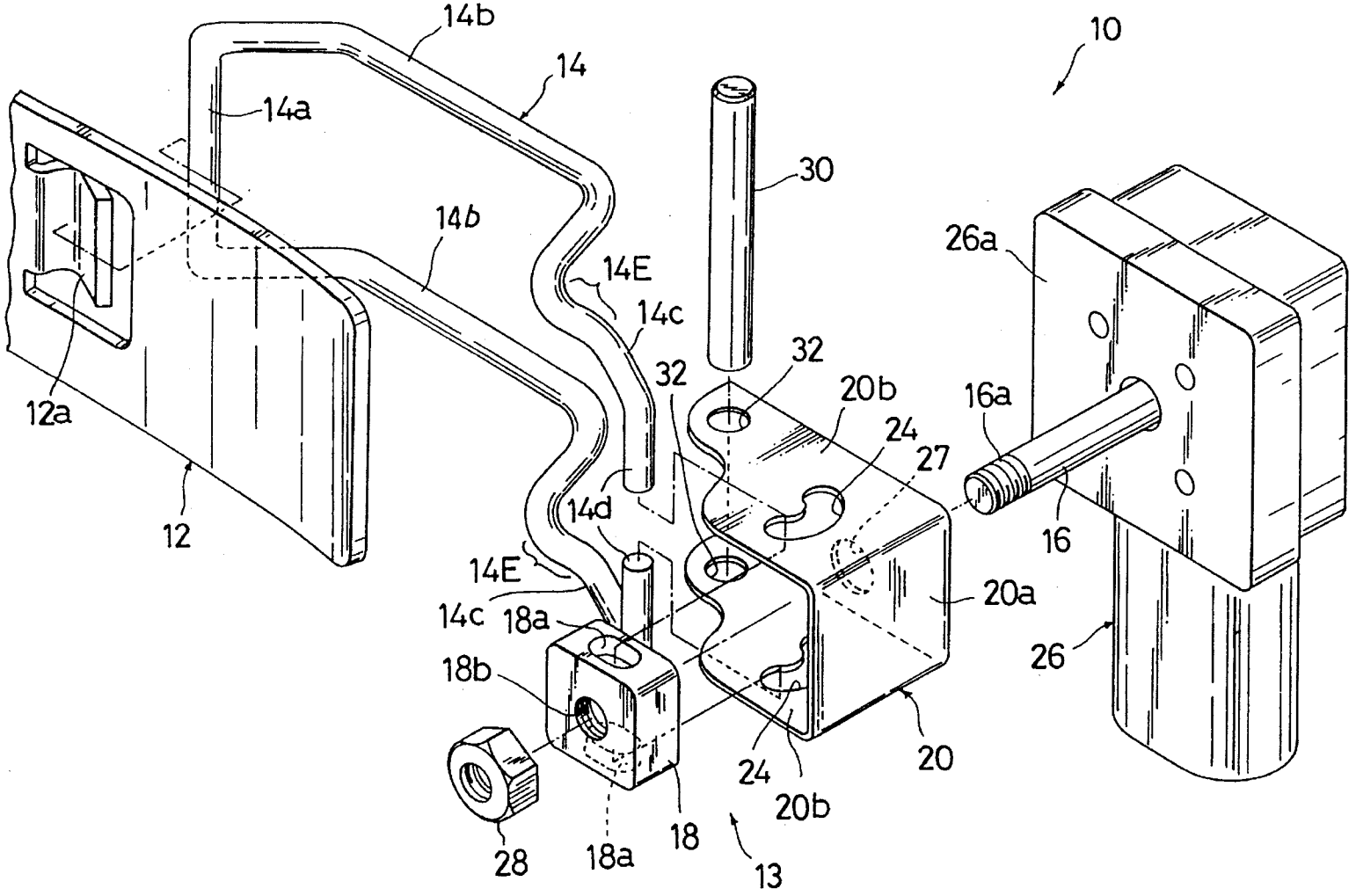
FIG. 2 is pertly broken perspective view of a lumbar support device in accordance with the present invention.

In FIGS. 2 and 3, designated generally by (10) is one preferred mode of a lumbar support device in accordance with the present invention. The lumbar support device (10) is provided within a seat back (22) of an automotive seat, as shown in FIG. 5, such as to move a lumbar plate (12) forwardly and backwardly of the seat back (22) to adjustably support the lumbar part of an occupant on the seat. However, FIGS. 4(A) and 4(B) show a diagram of basic principle which embodies a principal action of the present invention applicable to various modes of lumbar support device conceivable within the gist of the present invention, not to mention that illustrated mode (10), with a view to solving the above-discussed conventional problem of lateral dislocation of lumbar support point found in the prior-art lumbar support device.

At the outset, a description will be made as to the generic principle of lumbar support device in the present invention, with reference to FIGS. 4(A) and 4(B).

Figure 4:
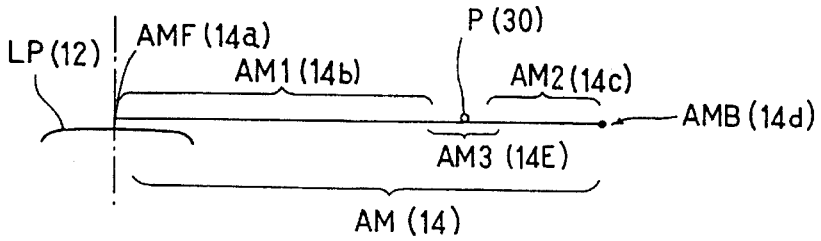
FIGS. 4(A) and 4(B) are diagrams showing a basic principle of actions of the lumbar support device.
Figure 4:
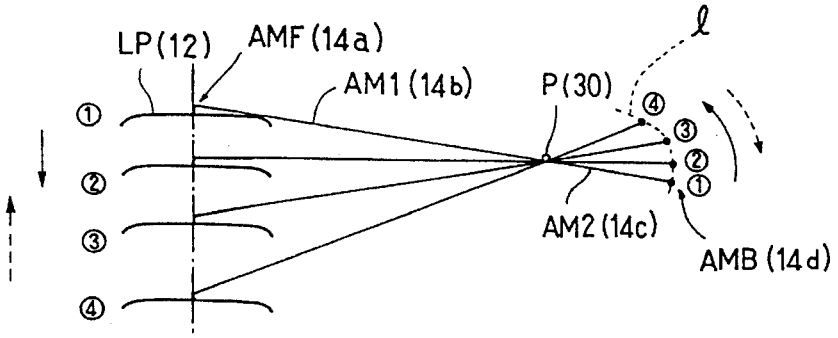
Figure 5:
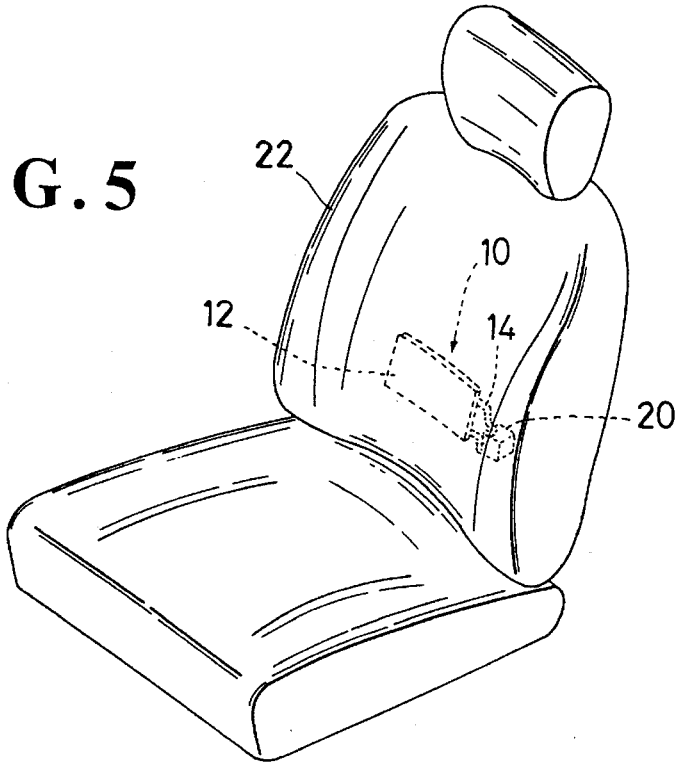
FIG. 5 is a perspective view of an automotive seat to which the present invention is applied.

As understandable in both FIGS. 4(A) and (4B), the aim of the invention is to produce a straight-line or linear displacement of a lumbar plate (LP) from the rotational motion of an arm (AM) about a support rod (P), in order to offer a stable support touch to the occupant's lumbar part in the fore-and-aft direction of the seat back (22). In this context, thhe support rod (P) serves as a point of rotation or fulcrum for the arm (AM). FIG. 4(A) schematically shows a basic construction of lumbar support device for that purpose, which essentially consists of an arm (AM), a support rod (P) and a lumbar plate (LP), such that the lumbar plate (LP) is rotatably connected at the central part thereof to the free end portion (AMF) of the arm (AM), with the arm being slidably supported on or contacted with the support rod (P) at the fulcrum point thereof (at AM3), and the base end portion (AMB) of the arm (AM) opposite to the free end portion (AMF) is operatively connected with a threaded drive mechanism and motor for causing rotative displacement of the arm (AM) in a clockwise or anticlockwise direction relative to the the support rod (P), as indicated by the arrows in FIG. 4(B). The threaded drive mechanism and motor is not shown in the FIGS. 4(A) and 4(B), but equivalent to the ones (13 and 26) of one embodiment (10) shown in FIG. 2 and 3, which will be described in details later.

Here, experiments have shown that the linear motion of the lumbar plate (LP) along the straight-line direction as indicated by the one-dot chain line as in FIG. 4(B) requires an unfixed or free slidable area (AM3) in the fulcrum of the arm (AM) that contacts the support rod (P) and a generally arcuate guide passage (l) along which the base end portion (AMB) of arm (AM) is moved. In other words, referring to FIG. 4(B), as the lumbar plate (LP) moves from an initial position (①) towards a given final position (④) on a straight line, the fulcrum of the arm (AM) is dislocated relative to the support point of support rod (30) progressively towards that final position (④), which makes gradually longer one arm section (AM1) of the arm (AM) while making gradually shorter another opposite arm section (AM2) thereof, whereby the base end portion (AMB) of the same arm (AM) is moved on a generally arcuate path with respect to the fixed support point (at P), describing such arcuate locus (l). Hence, according to the present invention, a basic structure for realizing such principle of linear motion may be formed by defining a proper free slidable area (AM3) in the fulcrum of the arm (AM) and a proper arcuate guide slit conforming to the arcuate locus (l) sufficient to materialize a predetermined linear movement of the lumbar plate (LP) in the fore-and-aft direction of the seat back (22).

Now, referring to FIGS. 2, 3 and 5, there is illustrated one preferred embodiment of lumbar support device (10) which materializes the above-discussed principle of the present invention by way of one example. According thereto, a lumbar plate (12) is rotatably secured via its securing lug (12*a*) to the free end section (14*a*) of an arm (14), and the arm (14) is operatively connected via a threaded drive mechanism (13) to a motor (26).

The lumbar plate (12) may be formed from a metal or a hard synthetic resin material in a proper shape to receive the lumbar part of a passenger on a seat (see FIG. 5).

The arm (14) is shown to be so formed by bending a steel wire or the like as to define therein the foregoing free end section (14*a*), a longer arm section (14*b*), a shorter arm section (14*c*) offset from the longer arm section (14*b*), a free slidable arm section (14E) between those two arm sections (14*b*)(14*c*) and a pair of mutually opposed base end sections (14*d*), in an integral manner.

The threaded drive mechanism (13) is basically formed by: a base bracket (20) of generally box-like shape; a pair of generally arcuate guide holes (24)(24) which are respectively formed in both lateral walls (20*b*)(20*b*) of the base bracket (20); a support rod (30) fixedly secured in the base bracket (20); a nut block member (18); and an outwardly threaded part (16) which is formed on an output shaft (16) connected to the motor (26) via a reduction gear (26*a*). As best seen in FIG. 2, the base bracket (20) has, formed therewith, a pair of lateral walls (20*b*)(20*b*) and a base wall (20*a*), thus opening at one side opposite to the base wall (20*a*). The support rod (30) is fixed in both securing holes (32)(32) formed in both lateral walls (20*b*)(20*b*) of base bracket (20). The output shaft (16) is rotatably inserted through a hole (27) formed in the base wall (20*a*) of base bracket (20), so that the outwardly threaded part (16*a*) is disposed within the base bracket (2). The nut block member is formed with an inwardly threaded hole (18*b*) in the base wall thereof and with a pair of elongated guide holes (18*a*)(18*a*) in the respective opposite side walls thereof. The outwardly threaded part (16*a*) of output shaft (16) is engaged threadedly in the inwardly threaded hole (18*b*) of the nut block member (18), while being further in threaded engagement with the nut-type stopper (28). The stopper (28) serves to limit the length range of the outwardly threaded part (16*a*) within which the nut block member (18) is moved in threaded engagement therewith. Namely, the stopper (28) may be rotated about the outwardly threaded part (16*a*) and positioned at a desired point so as to increase or decrease the threaded engageable range between the nut block member (18) and outwardly threaded part (16*a*). In this respect, both outwardly threaded part (16*a*) and output shaft (16) forms a lead screw spindle with respect to the nut block member (18), and thus, operation of the motor causes rotation of the outwardly threaded part (16*a*) to move the nut block member (18) along the longitudinal direction of output shaft (16) within a movable range limited by the stopper (28).

It is noted that the two elongated guide holes (18*a*) (18*a*) should be aligned with the two arcuate guide holes (24)(24), respectively, in such a way that the former holes (18*a*) extend transversely of the respective latter holes (24) for a purpose to be set forth later.

Slidably inserted through all those paired arcuate and elongated guide holes (24)(18*a*) are the mutually faced two base end sections (14*d*)(14*d*) of the arm (14), so that the arm (14) is operatively connected with the motor (26). Namely, upon the motor (26) worked, the nut block member (18) is moved in the fore-and-aft direction of the seat as understandable from FIGS. 3 and 5, and such fore-and-aft motion of nut block member (18) causes both two base end sections (14*d*)(14*d*) of arm (14) to be moved in the same direction, which in turn guides the two arm end sections (14*d*) along the arcuate guide holes (24) with the aid of the elongated guide holes (18*a*) offering a lateral escape zone to the longitudinal motion of the arm end sections (14*d*).

The arm (24) thus assembled is set in a given initial lumbar supprot position as indicated by the solid line in FIG. 3, with the paired slidable sections (14E) thereof in contact with both end portions of the support rod (30) projected from the respective lateral walls (20*b*) of base bracket (20).

It is essential that such arcuate guide holes (24) should be formed in conformity with a required arcuate locus to be described by the arm base end sections (14*d*) in order for the opposite free end arm section (14*a*) or the lumbar plate (12) to move on a straight line, on the basis of the principle shown in FIGS. 4(A) and 4(B). In this connection, both arcuate guide holes (24) and slidable arm sections (14E) should be of a proper length to meet a required stroke range of the fore-and-aft displacement of the lumbar plate (12).

With the above-described construction, to control the normal and reverse drive of the motor (26) will effect a fore-and-aft displacement of the nut block member (18) so as to cause the base end sections (14d) of arm (14) to be slidingly moved along the arcuate guide holes (24), with respect to the support rod (30), as a result of which, the free end section (14*a*) of arm (14) will be displaced relative to the support rod (30) in a straight-line direction indicated by the linear one-dot chain line in FIG. 3, with the slidable intermediate sections (14E) of the arm (14) being slid on the support rod (30) in contact therewith. Thus, by virtue of such free dislocation of fulcrum at which the rotation center of the arm (14) is set, the lumbar plate (12) is not confined to a circular rotation wherein the center of rotation is fixed as stated in the description of prior art, and further, with the guiding aid of the generally arcuate guide hole (24), the lumbar plate (12) is positively guided to effect a stable linear fore-and-aft motion with respect to the seat back (22).

The movable range of such linear fore-and-aft motion of the lumbar plate (12) may be adjustably determined by rotating the foregoing stopper (28) about the outwardly threaded part (16*a*) as previously described.

The arm (14) is not limited to a particular shape and may be formed either in a rectilinear shape as in FIGS. 4(A) and 4(B) or in a generaly zigzag shape as in FIGS. 2 and 3. In both cases, the abovementioned princple of the present invention may be directly applied, without substantive difference in effects therebetween. But, more strictly stated, by making a comparison between the rectilinear arm (AM) and the irregulary bent arm (14), it can be observed that the longer arm section (14*b*) of the irregularly bent arm (14) equivalent to that (AM1) of the rectilinear arm (AM) is recessed more backwardly, thereby permitting the lumbar plate initial position to be set more backwardly within the seat back (22), and that the shorter arm section (14*c*) of the former (14) equivalent to that (AM2) of the latter (AM) is inclined forwardly, thereby permitting the guide hole (24) to be formed in a smaller and clear-cut arcuate shape. This is however a mere choice of design and does not weight distinctively in the present invention.

Preferably, the arm (AM or 14) may basically be formed by bending a torsion bar into a generaly "U" shape, as assumable from the FIG. 2.

Accordingly, in accordance with the present invention, it is appreciated that (i) the lumbar plate (LP or 12) is moved on a straight line, without dislocation or wobbling in the width-wise direction of the seat back (22), to thereby provide a stable support or pressing touch to the lumbar part of a passenger on the seat, and that (ii) the lumbar support device per se may be assembled with a relatively simplified structure, because it basically suffices to define the combination of arcuate and elongated holes (24)(18*a*) between the base end section (14*d*) of arm (14) and the known threaded drive mechanism (13), and define a slidable intermediate section (14E) in the known arm (14). In addition, the fore-and-aft movable range of the lumbar plate (12) may be adjustably set by means of the stopper (28), which allows the lumbar support device (10) per se to be mounted in various different shapes of seat backs. This contributes greatly to a reduction of costs as well as of parts for assemblage of various sorts of seats.

While having described the present invention thus far, it should be understood that the invention is not limited to the illustrated embodiment, but any other modifications, replacements and additions may be applied thereto structurally without departing from the scopes of appended claims. For example, a rotary operation knob may be connected to the lead screw spindle or the output shaft (16) in order to permit a manual operation of the lumbar support device (10), in place of the motor (26). The lumbar support device in accordance with the present invention may be applied to other various types of seats used in a train, airplane, ship, office, movie theater, or library.

What is claimed is:

1. A lumbar support device for a seat, comprising:

a lumbar plate to support a lumbar part of an occupant sitting on the seat;

an arm means having a free end portion on which said lumbar plate is supported, an intermediate portion and a base end portion;

a bracket means;

a fulcrum means which so disposed at said bracket means as to receive said intermediate portion of said arm means in such a way that said arm means intermediate portion is in a slidable contact with said fulcrum means;

a threaded drive mechanism provided in said bracket means, said threaded drive mechanism being operatively connected with said base end portion of said arm, whereby said arm base end portion is caused to move in a direction forwardly and backwardly of the seat; and a guide means workable in conjunction with said threaded drive mechanism to guide said arm base end portion along a predetermined locus, whereby said free end portion of said arm is displaced on a straight line in said direction forwardly and backwardly of the seat, wherein operation of said threaded drive mechanism causes displacement of said lumbar plate on said straight line in a direction towards and away from said lumbar part of said occupant on the seat.

2. The lumbar support device according to claim 1, wherein said arm means is so disposed forwardly of said fulcrum means that said intermediate portion of said arm means is directly applied a load from said lumbar part of the occupant and received by said fulcrum means in the slidable contact therewith.

3. The lumbar support device according to claim 1, wherein said fulcrum means comprises a support rod fixed in said bracket means.

4. The lumbar support device according to claim 1, wherein said arm means comprises an arm formed from one of a steel wire or a torsion bar.

5. The lumbar support device according to claim 1, wherein said threaded drive mechanism comprises a lead screw spindle and a nut block member, both of which are threadedly engaged with each other, and wherein said lead screw spindle is operable by an external drive means, while said nut block member is connected with said base end portion of said arm via said guide means.

6. The lumbar support device according claim 5, wherein said external drive means comprises one of a motor and a manual rotary operation means.

7. The lumbar support device according to claim 1, wherein said guide means comprises a generally arcuate guide hole which is formed in conformity with said predetermined locus in order for said free end portion of said arm to be displaced on the straight line in said direction forwardly and backwardly of the seat.

8. The lumbar support device according to claim 1, wherein a stopper means is so operatively provided in said threaded drive mechanism as to permit for adjustably limiting a range within which said arm base end portion is moved in said direction forwardly and backwardly of the seat.

9. A lumbar support device for a seat, comprising:

a lumbar plate to support a lumbar part of an occupant sitting on the seat;

an arm means having a free end portion on which said lumbar plate is supported, an intermediate portion and a base end portion;

a bracket means;

a fulcrum means which so disposed at said bracket means as to receive said intermediate portion of said arm means in such a way that said arm means intermediate portion is in a slidable contact with said fulcrum means;

a threaded drive mechanism provided in said bracket means, said threaded drive mechanism comprising a lead screw spindle and a nut block member, both of which are threadedly engaged with each other, wherein said lead screw spindle is operable externally of the lumbar support device and said nut block member is connected with said base end portion of said arm;

a generally arcuate guide hole formed in said bracket means in conformity with a predetermined locus along which said base end portion of said arm has to be moved in order for said free end portion of said arm to be displaced on a straight line in said direction forwardly and backwardly of the seat;

an elongated guide hole formed in said nut block member of said threaded drive mechanism; and said base end portion of said arm being slidably inserted through said generally arcuate guide hole and said elongated guide hole;

wherein operation of said threaded drive mechanism causes said nut block member to be moved along said lead screw spindle, whereby said arm base end portion is guided along said predetermined locus via said generally arcuate and elongated guide holes, thereby causing displacement of said arm free end portion to be displaced on a straight line in said direction forwardly and backwardly of the seat, so that said lumbar plate is displaced on said straight line in a direction towards and away from said lumbar part of said occupant on the seat.

10. The lumbar support device according to claim 9, wherein fulcrum means comprise a support rod fixed in said bracket means.

11. The lumbar support device according to claim 9, wherein said generally arcuate guide hole extends generally in a direction along said direction forwardly and backwardly of the seat, and wherein said elongated guide hole extends generally in a direction transversely of said generally arcuate hole.

12. The lumbar support device according to claim 9, wherein a stopper means is so operatively provided in said threaded drive mechanism as to permit for adjustably limiting a range within which said arm base end portion is moved in said direction forwardly and backwardly of the seat.

* * * * *